US012060771B2

(12) United States Patent
Bustamante Rodriguez et al.

(10) Patent No.: US 12,060,771 B2
(45) Date of Patent: Aug. 13, 2024

(54) DOWNHOLE CLEAN OUT TOOL

(71) Applicant: Saudi Arabian Oil Company, Dhahran (SA)

(72) Inventors: Victor Jose Bustamante Rodriguez, Abqaiq (SA); Sajid Hussain, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 68 days.

(21) Appl. No.: 17/883,144

(22) Filed: Aug. 8, 2022

(65) Prior Publication Data

US 2024/0044224 A1 Feb. 8, 2024

(51) Int. Cl.

*E21B 34/14* (2006.01)
*E21B 31/08* (2006.01)
*E21B 37/08* (2006.01)

(52) U.S. Cl.

CPC ..... *E21B 34/14* (2013.01); *E21B 31/08* (2020.05); *E21B 37/08* (2013.01)

(58) Field of Classification Search

CPC ..... E21B 34/14; E21B 37/08; E21B 37/00; E21B 31/08

See application file for complete search history.

(56) References Cited

U.S. PATENT DOCUMENTS 1,746,132 A 2/1930 Stokes
1,968,282 A 7/1934 Cavins
2,645,290 A * 7/1953 Fortenberry ..... E21B 31/08 166/99
2,908,332 A * 10/1959 Nedow ..... E21B 27/00 166/99
3,011,571 A 12/1961 De Bree et al.
3,023,810 A 3/1962 Anderson
3,398,794 A 8/1968 Fox, Jr.
3,997,010 A * 12/1976 Rilling ..... E21B 10/32 175/242
4,059,155 A * 11/1977 Greer ..... E21B 31/08 166/99

(Continued)

FOREIGN PATENT DOCUMENTS

CN 104563872 4/2015
EP 0107630 2/1984

OTHER PUBLICATIONS

U.S. Appl. No. 17/245,241, filed Apr. 30, 2021, Ali et al.

*Primary Examiner* — Steven A MacDonald
(74) *Attorney, Agent, or Firm* — Fish & Richardson P.C.

(57) ABSTRACT

A downhole clean out tool includes a housing coupled to a downhole conveyance and defining an inner volume that includes a flow path that extends from an uphole end to a downhole end that includes a fluid inlet; a first flow port oriented towards the downhole end and configured to fluidly couple the flow path to an annulus of the wellbore through the housing; a seat formed in the housing and configured to receive a member inserted into the wellbore such that the flow of the wellbore fluid is diverted from the flow path, through the first flow port, to the annulus, and to the fluid inlet based on the member seated on the seat; at least one screen positioned in the inner volume; and a second flow port oriented towards the uphole end and configured to fluidly couple the flow path to the annulus of the wellbore.

23 Claims, 3 Drawing Sheets

(56) References Cited

U.S. PATENT DOCUMENTS 4,072,166 A 2/1978 Tiraspolsky et al.
4,308,917 A 1/1982 Disnnukes
4,421,182 A 12/1983 Moody et al.
4,493,383 A 1/1985 Williams et al.
4,494,618 A 1/1985 Radtke
4,924,940 A 5/1990 Burroughs et al.
4,940,092 A * 7/1990 Ferguson ..... E21B 27/00 166/105.3
4,986,361 A 1/1991 Mueller et al.
5,033,545 A * 7/1991 Sudol ..... E21B 41/0078 134/167 C
5,117,915 A 6/1992 Mueller et al.
5,181,571 A 1/1993 Mueller et al.
5,713,423 A 2/1998 Martin et al.
6,276,452 B1 * 8/2001 Davis ..... E21B 41/00 166/99
6,390,211 B1 5/2002 Tibbitts
6,401,822 B1 6/2002 Baugh et al.
6,505,685 B1 1/2003 Sullaway et al.
6,679,336 B2 1/2004 Musselwhite et al.
6,712,145 B2 3/2004 Allamon
6,758,281 B2 7/2004 Sullaway et al.
7,013,997 B2 3/2006 Vail
7,383,881 B2 * 6/2008 Telfer ..... E21B 21/103 175/323
7,413,020 B2 8/2008 Carter et al.
7,640,984 B2 1/2010 Vert et al.
7,665,546 B2 2/2010 Ruttley
7,681,645 B2 * 3/2010 McMillin ..... E21B 34/14 166/291
8,789,582 B2 7/2014 Rondeau et al.
9,074,455 B2 7/2015 Pilgrim et al.
9,222,323 B2 * 12/2015 Skjeie ..... E21B 27/04
9,303,482 B2 4/2016 Hall et al.
10,323,464 B1 6/2019 Al-AbdulJabbar
11,421,512 B1 8/2022 Egbe et al.
2003/0070815 A1 4/2003 Sullaway et al.
2003/0070816 A1 4/2003 Sullaway et al.
2003/0116324 A1 6/2003 Dawson et al.
2003/0205377 A1 11/2003 Streater
2006/0027360 A1 2/2006 Basso
2006/0076133 A1 * 4/2006 Penno ..... E21B 43/045 166/278
2006/0219441 A1 * 10/2006 Telfer ..... E21B 37/00 175/325.7
2008/0210429 A1 * 9/2008 McMillin ..... E21B 43/14 166/313
2008/0277119 A1 11/2008 Hill et al.
2011/0290344 A1 12/2011 Groesbeck et al.
2014/0216756 A1 8/2014 Getzlaf et al.
2014/0338896 A1 11/2014 McGarian et al.
2014/0360725 A1 * 12/2014 Xu ..... E21B 34/14 166/99
2015/0211316 A1 * 7/2015 Skjeie ..... E21B 34/14 166/99
2017/0138153 A1 5/2017 Getzlaf et al.
2018/0291706 A1 * 10/2018 Kehoe ..... E21B 43/35
2022/0268114 A1 8/2022 Egbe et al.

* cited by examiner

DOWNHOLE CLEAN OUT TOOL

TECHNICAL FIELD

The present disclosure describes a downhole clean out tool for a wellbore.

BACKGROUND

Oil wells are completed in order to put the well on production of hydrocarbons fluids. Many types of completions are available in the market, from simple production packer completions to more complex completions, such as smart completion to be used for multiple producing sections or compartment, cables, valves and packers. Before installing any type of completion, a wellbore should be cleaned through multiple cleanout runs that are performed to remove metallic junk, debris, and other unwanted items present in the wellbore due to earlier drilling operations. Depending on the type of well and completion to be used, multiple clean out run are done, and in addition to this, the fluid system is cleaned at a surface in order to meet a turbidity requirement for the completion fluids. The more specialized completion may require more clean-out runs and more time will be spent to make the well ready (clean) in order to meet completion installation criteria.

SUMMARY

In an example implementation, a downhole clean out tool includes a sub-assembly configured to couple to a downhole conveyance that extends in a wellbore from a terranean surface to a subterranean formation; a housing coupled to the sub-assembly and defining an inner volume that includes a flow path that extends from an uphole end of the housing, through the housing, and to a downhole end of the housing that includes a fluid inlet; a first flow port including an outlet oriented towards the downhole end of the housing and configured to fluidly couple the flow path to an annulus of the wellbore through the housing to direct a flow of a wellbore fluid circulated into the housing through the uphole end into the annulus in a downhole direction; a seat formed in the housing and configured to receive a member inserted into the wellbore such that the flow of the wellbore fluid is diverted from the flow path, through the first flow port, to the annulus, and to the fluid inlet based on the member seated on the seat; at least one screen positioned in the inner volume and configured to catch one or more debris in the flow of the wellbore fluid circulated into the flow path through the fluid inlet; and a second flow port including an outlet oriented towards the uphole end of the housing and configured to fluidly couple the flow path to the annulus of the wellbore through the housing to direct the flow of the wellbore fluid circulated into the flow path through the fluid inlet into the annulus in an uphole direction.

In an aspect combinable with the example implementation, the inner volume includes a first inner volume portion and a second inner volume portion.

Another aspect combinable with any of the previous aspects further includes a flow divider that fluidly separates the first inner volume portion from the second inner volume portion, the flow divider including or forming the seat.

In another aspect combinable with any of the previous aspects, the first flow port is positioned to receive the flow of the wellbore fluid in the first inner volume portion, and the second flow port fluidly couples the second inner volume portion to the annulus through the flow divider.

In another aspect combinable with any of the previous aspects, the at least one screen is mounted in the second inner volume portion.

In another aspect combinable with any of the previous aspects, the flow path is formed by a flow path tube that extends in the inner volume between the uphole end of the housing and the downhole end of the housing.

In another aspect combinable with any of the previous aspects, the flow divider is mounted within the flow path tube.

Another aspect combinable with any of the previous aspects further includes a plurality of first flow ports that include the first flow port, each of the plurality of first flow ports fluidly coupled within the housing by at least one fluid tube that extends through an annulus between the housing and the flow path tube; and a plurality of second flow ports that include the second flow port.

Another aspect combinable with any of the previous aspects further includes at least one magnetic member mounted within the flow path and configured to magnetically attract at least a portion of the one or more debris.

Another aspect combinable with any of the previous aspects further includes a check valve mounted in the second flow port and configured to prevent wellbore fluid circulated into the flow path from the annulus.

In another example implementation, a method of cleaning out at least a portion of a wellbore includes running a downhole clean out tool into a wellbore on a downhole conveyance that extends in a wellbore from a terranean surface to a subterranean formation. The downhole clean out tool includes a sub-assembly coupled to the downhole conveyance, a housing coupled to the sub-assembly and defining an inner volume that includes a flow path that extends from an uphole end of the housing, through the housing, and to a downhole end of the housing that includes a fluid inlet, a first flow port that extends through the housing and includes an outlet oriented towards the downhole end of the housing, a seat formed in the housing, at least one screen positioned in the inner volume, and a second flow port that extends through the housing and includes an outlet oriented towards the uphole end of the housing. The method further includes dropping a member into the wellbore to land on the seat; subsequently to the member landing on the seat, diverting a wellbore fluid circulated to the downhole clean out tool through the downhole conveyance from the flow path, through the first flow port, to an annulus of the wellbore, to the fluid inlet, and back into the flow path; catching, with the at least one screen, one or more debris in the flow of the wellbore fluid circulated into the flow path through the fluid inlet; and directing the flow of the wellbore fluid circulated into the flow path from the fluid inlet into the annulus through the second flow port in an uphole direction.

An aspect combinable with the example implementation further includes directing the wellbore fluid through a plurality of screens that includes the at least one screen, at least two of the plurality of screens having different mesh sizes.

In another aspect combinable with any of the previous aspects, the inner volume includes a first inner volume portion and a second inner volume portion, and the downhole clean out tool further includes a flow divider that fluidly separates the first inner volume portion from the second inner volume portion.

In another aspect combinable with any of the previous aspects, the flow divider including or forming the seat.

Another aspect combinable with any of the previous aspects further includes directing the wellbore fluid from the second inner volume portion through the flow divider with the second flow port.

In another aspect combinable with any of the previous aspects, the flow path is formed by a flow path tube that extends in the inner volume between the uphole end of the housing and the downhole end of the housing.

In another aspect combinable with any of the previous aspects, the flow divider is mounted within the flow path tube.

In another aspect combinable with any of the previous aspects, diverting the wellbore fluid circulated to the downhole clean out tool through the downhole conveyance from the flow path, through the first flow port includes diverting the wellbore fluid from the flow path to at least one fluid tube that extends through an annulus between the housing and the flow path tube; and directing the wellbore fluid from the at least one fluid tube to a plurality of first flow ports that includes the first flow port.

Another aspect combinable with any of the previous aspects further includes magnetically attracting at least a portion of the one or more debris to at least one magnetic member mounted within the flow path.

Another aspect combinable with any of the previous aspects further includes preventing a flow of the wellbore fluid into the flow path from the annulus through the second flow port with a check valve mounted in the second flow port.

Another aspect combinable with any of the previous aspects further includes, while diverting the wellbore fluid, moving the downhole clean out tool within the wellbore in an uphole or downhole direction on the downhole conveyance.

Another aspect combinable with any of the previous aspects further includes moving the member onto the seat by circulating the wellbore fluid with the member through the downhole conveyance and into the housing.

In another example implementation, a bottom hole assembly (BHA) includes a top sub-assembly configured to couple to a downhole conveyance that extends in a wellbore from a terranean surface to a subterranean formation; a bottom sub-assembly including a flow inlet configured to receive a flow of a wellbore fluid; and a downhole clean out tool fluidly coupled to the top and bottom sub-assemblies. The downhole clean out tool includes a housing coupled to the top and bottom sub-assemblies and defining an inner volume that includes a flow path that extends from an uphole end of the housing in fluid communication with the top sub-assembly, through the housing, and to a downhole end of the housing that includes a fluid inlet; a first flow port including an outlet oriented towards the downhole end of the housing and configured to fluidly couple the flow path to an annulus of the wellbore through the housing to direct a flow of a wellbore fluid circulated into the housing through the uphole end into the annulus in a downhole direction; a seat formed in the housing and configured to receive a member inserted into the wellbore such that the flow of the wellbore fluid is diverted from the flow path, through the first flow port, to the annulus, and to the fluid inlet based on the member seated on the seat; at least one screen positioned in the inner volume and configured to catch one or more debris in the flow of the wellbore fluid circulated into the flow path, through the flow inlet of the bottom sub-assembly, and through the fluid inlet; and a second flow port including an outlet oriented towards the uphole end of the housing and configured to fluidly couple the flow path to the annulus of the wellbore through the housing to direct the flow of the wellbore fluid circulated into the flow path through the fluid inlet into the annulus in an uphole direction.

An aspect combinable with the example implementation further includes a cage positioned on the fluid inlet and configured to retain at least a portion of the one or more debris.

In another aspect combinable with any of the previous aspects, the bottom sub-assembly includes a mule shoe sub-assembly.

In another aspect combinable with any of the previous aspects, the housing of the downhole clean out tool is threadingly coupled to each of the top and bottom sub-assembly.

In another aspect combinable with any of the previous aspects, the downhole clean out tool is 30 feet in length.

In another aspect combinable with any of the previous aspects, the downhole conveyance includes a tubular work string.

Implementations of a downhole clean out tool according to the present disclosure may include one or more of the following features. For example, a downhole clean out tool according to the present disclosure can catch and remove debris of various material, such as metallic and non-metallic debris (such as rubber or plastic). As another example, a downhole clean out tool according to the present disclosure can remove a large amount of solids in a wellbore fluid that can cause problems for future wellbore completion operations. As another example, a downhole clean out tool according to the present disclosure can remove debris without employing vacuum equipment but instead can use a reverse circulation action of a wellbore fluid. Further, a downhole clean out tool according to the present disclosure can comprise a less complex and elegant design that reduces maintenance or mechanical problems with the tool as compared to convention clean out tools. Also, a downhole clean out tool according to the present disclosure can improve a clean out process before running any completion equipment into a wellbore. As another example, a downhole clean out tool according to the present disclosure can minimize a time spent performing clean out trips in a wellbore. As a further example, a downhole clean out tool according to the present disclosure can recover more debris (or "junk") of different size and type and at the same time, perform an initial filtration of wellbore fluid in a wellbore. As another example, a downhole clean out tool according to the present disclosure can prevent or help prevent a stuck completion operation with junk in the wellbore. As another example, a downhole clean out tool according to the present disclosure can increase a flushing efficiency in an annulus of the wellbore.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
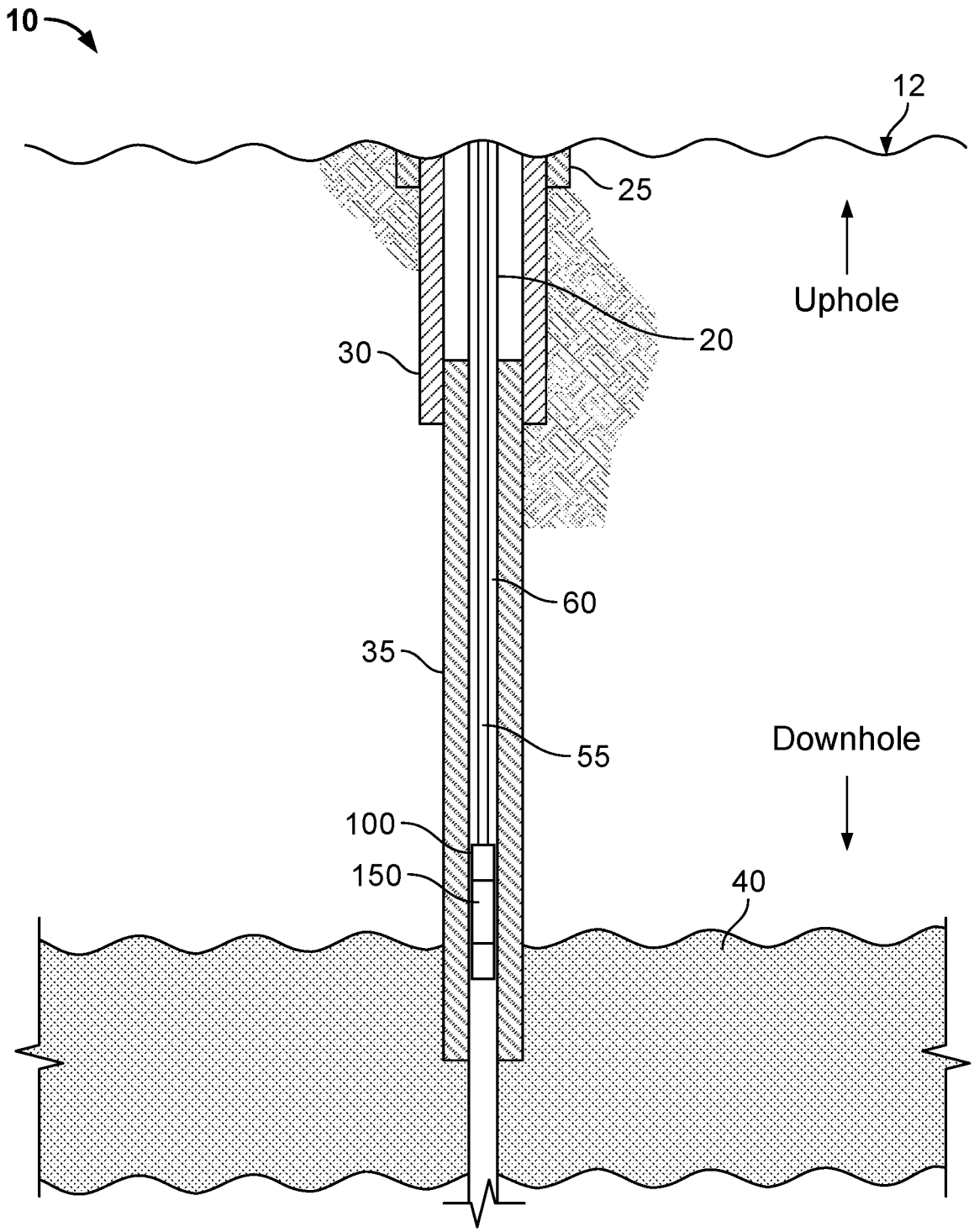
FIG. 1 is a schematic diagram of an example implementation of a wellbore system that includes a downhole clean out tool according to the present disclosure.

FIG. 1 is a schematic diagram of wellbore system 10 that includes a bottom hole assembly (BHA) 100 that includes a downhole clean out tool 150 according to the present disclosure. Generally, FIG. 1 illustrates a portion of one embodiment of a wellbore system 10 according to the present disclosure in which the downhole clean out tool 150 can move through a wellbore 20 as part of the BHA 100 (or exclusive of the BHA 100) on a downhole conveyance 55 such as a tubular work string (for example, made up of multiple tubulars made up, such as threadingly, together), coiled tubing, or other tubular conveyance. As described in further detail herein, the downhole clean out tool 150 can be used in a clean out process inside the wellbore 20 before any specialized or completion equipment is deployed, such as smart completion equipment or ESP completions. This can be achieved by employing a reverse circulation operation with the downhole clean out tool 150 that can circulate junk and small debris (for example, metallic or otherwise) within a wellbore fluid inside the clean out tool 150 to remove these elements through different mechanisms inside the tool 150. The different mechanisms can catch or remove such junk or debris depending, for example, on a size of the debris in the wellbore fluid and/or a material composition of the debris in the wellbore fluid.

The example downhole clean out tool 150 (as described more fully herein) can clean or help clean the wellbore fluid with one or more screens that, in some aspects, have different mesh sizes to catch or filter different sized debris. This can minimize a fluid filtration time at the terranean surface 12. In some aspects, the reverse circulation can be pressure activated. In some aspects, the junk or debris can be collected within the downhole clean out tool 150 and stored therein during a run out trip to be retrieved to the surface 12 (for example, after the BHA 100 is pulled out to the surface 12 and the tool 150 is cleaned by flushing an interior volume with water or any other liquid). In some aspects, an interior volume of the downhole clean out tool 150 can include one or more magnetized components in order to aid with the collection of metal parts and debris (for example, through magnetic attraction of the junk to the magnetized components). In some aspects, the downhole clean out tool 150 contains one or more mesh screens that have various mesh sizes selected to assist in cleaning the wellbore fluid as a preparation for deployment of a future completion operation.

According to the present disclosure, the downhole clean out tool 150 can move through the wellbore 20 in a bottom hole operation (such as a clean out operation) on the BHA 100 or independently (for example, directly attached to wellbore conveyance 55). In this example, as shown, the wellbore can include a production casing 35 that extends into a subterranean formation 40 and includes casing collars that connect joints of the production casing 35 together (for example, threading), in order to construct the casing 35. In some aspects, the downhole clean out tool 150 can be operated in a clean out operation during drilling operations and/or prior to, for example, whipstock or liner deployments and wireline cased hole logging operations.

As shown, the wellbore system 10 accesses the subterranean formation 40 and provides access to hydrocarbons located in such subterranean formation 40. In an example implementation of system 10, the system 10 may also be used for a completion and production operation in which the hydrocarbons may be produced from the subterranean formation 40 within a wellbore tubular (for example, through the production casing 35 or other production tubular).

A drilling assembly (not shown) may be used to form the wellbore 20 extending from the terranean surface 12 and through one or more geological formations in the Earth. One or more subterranean formations, such as subterranean formation 40, are located under the terranean surface 12. As will be explained in more detail below, one or more wellbore casings, such as a surface casing 30 and production casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

In example embodiments of the wellbore system 10, the wellbore 20 is cased with one or more casings, such as steel casings or other casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the production casing 35. Any of the illustrated casings, as well as other casings or tubulars that may be present in the wellbore system 10, may include one or more casing collars. In the example implementation of wellbore system 10, the production casing 35 and casing collars (as well as other tubular casings) can be made of steel.

Figure 2:
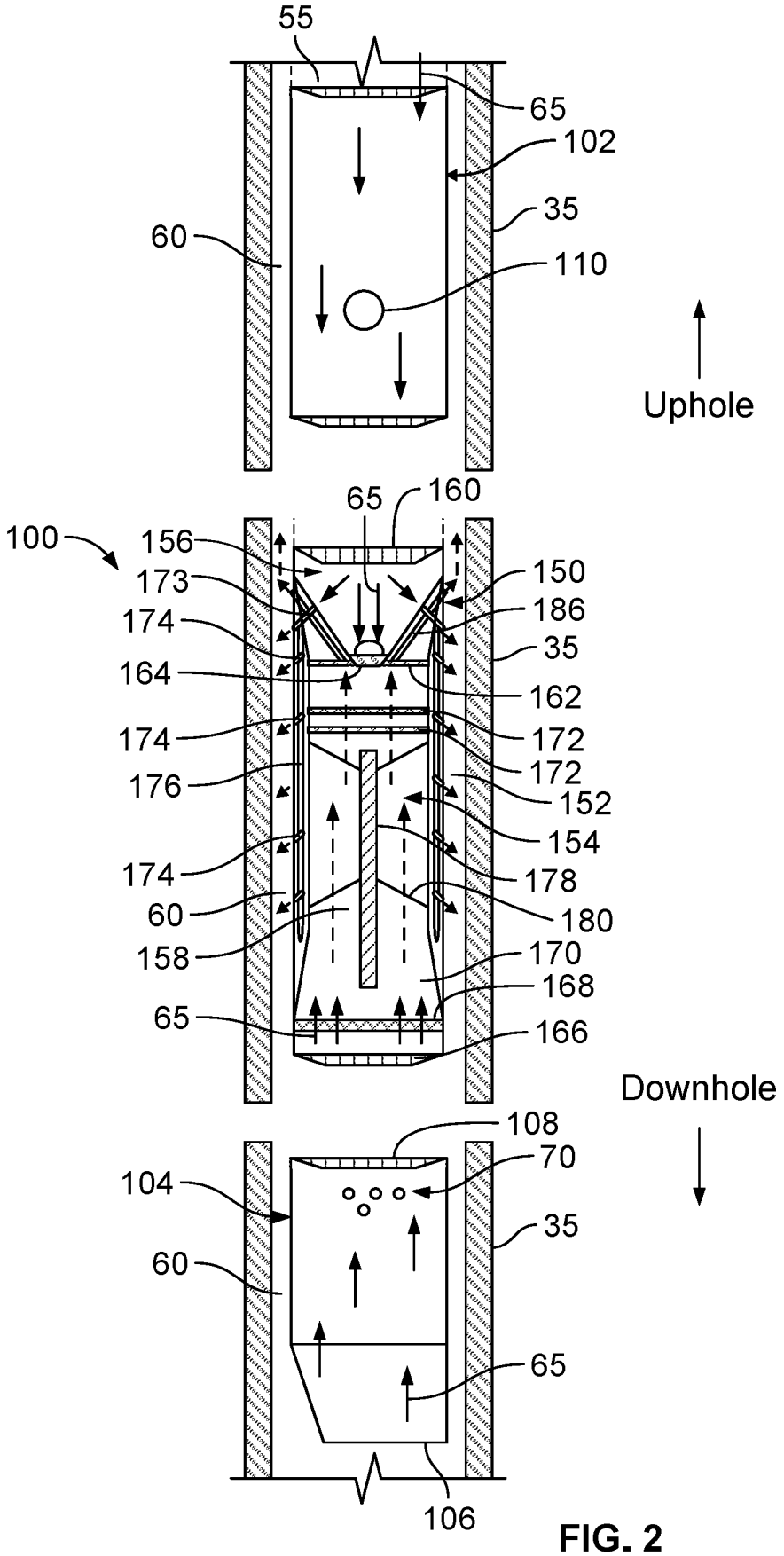
FIG. 2 is a schematic diagram of an example implementation of a downhole clean out tool as part of a bottom hole assembly according to the present disclosure.
Figure 3:
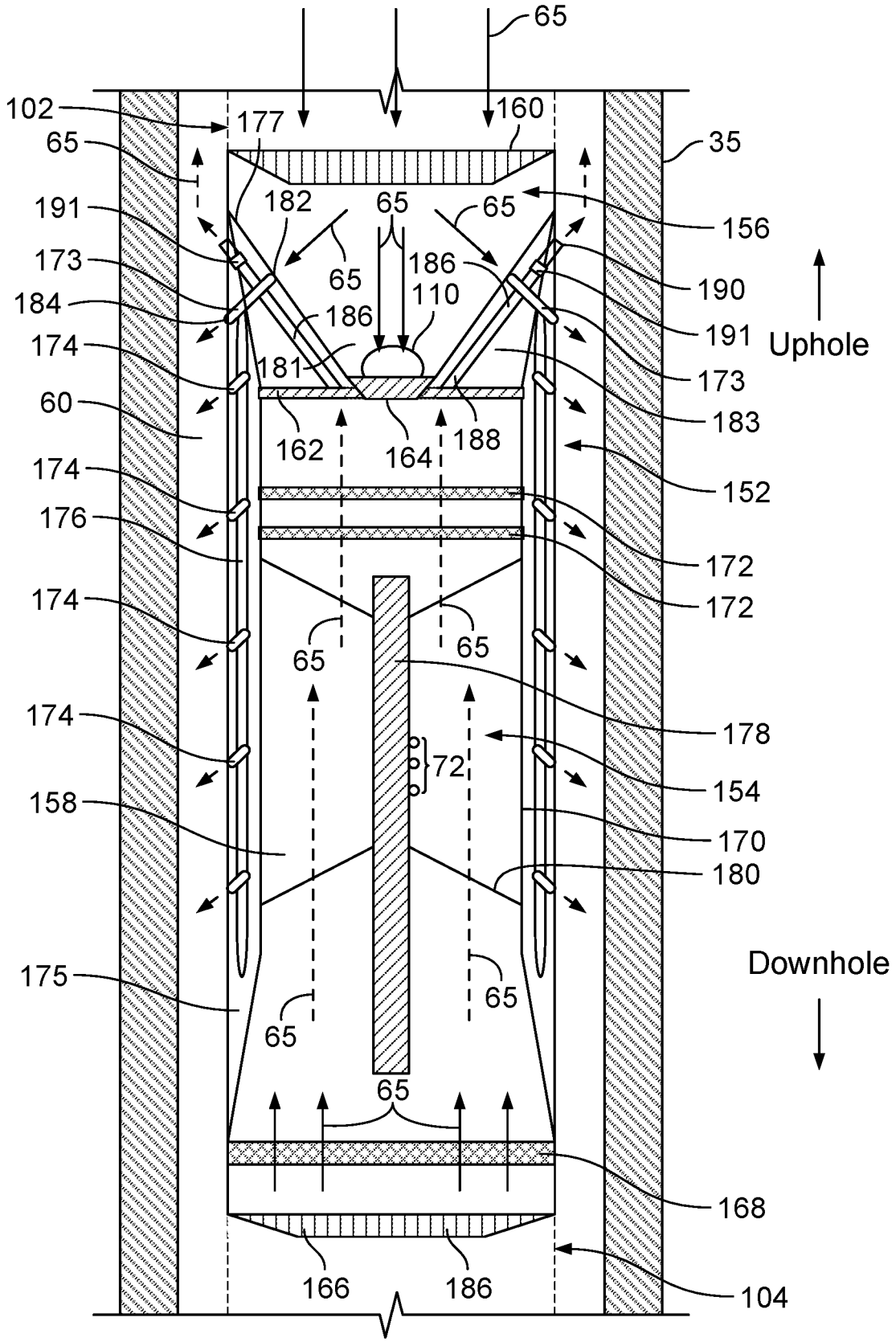
FIG. 3 is a schematic diagram of the example implementation of the downhole clean out tool according to the present disclosure.

Turning to FIGS. 2 and 3, these figures show schematic diagrams of the example implementation of the downhole clean out tool 150 as part of the BHA 100. As shown specifically, in FIG. 2, the downhole clean out tool 150 as part of the BHA 100 is shown in an exploded view of the BHA 100, which includes a top sub-assembly 102, the downhole clean out tool 150, and a bottom sub-assembly 104. In this example the downhole clean out tool 150 is connected (for example, threadingly or otherwise) between the top sub-assembly 102 and the bottom sub-assembly 104. For instance, the downhole clean out tool 150 provides an uphole connection 160 (for example, threaded or otherwise) with a fluid connection that can mate with a downhole end of the top sub-assembly 102 (which can be threaded to the downhole conveyance 55). The downhole clean out tool 150 provides a downhole connection 166 (also (for example, threaded or otherwise) with a fluid connection that can mate with an uphole end 108 of the bottom sub-assembly 104. Thus, a wellbore fluid 65 provided through the downhole conveyance 55 can circulate through and between the top sub-assembly 102, the downhole clean out tool 150, and the bottom sub-assembly 104, as well as within an annulus 60 of the wellbore between the BHA 100 and the casing 35.

In this example of the BHA 100, the bottom sub-assembly 104 includes a fluid inlet 106 at the downhole end of the BHA 100 through which the wellbore fluid 65, including debris can be circulated. In this example, the bottom sub-assembly 104 is a mule shoe assembly.

As explained in more detail herein, a member 110 can be circulated into the wellbore within the downhole conveyance 55, such as within a flow of the wellbore fluid 65. The member 110 can be a ball or a dart or other member shaped and sized to move within the downhole conveyance 55, into the top sub-assembly 102, and into the downhole clean out tool 150. As described more fully herein, the member 110 can come to a stationary position in a seat 164 of the downhole clean out tool 150 in order to activate a reverse circulation operation of the downhole clean out tool 150. The seat 164 can comprises a bore through a flow divider 162 positioned within the inner volume 154 that allows flow of a wellbore fluid there through when unsealed (for example, when member 110 is not on the seat 164) but is not open to flow there through when sealed (for example, when member 110 is on the seat 164).

FIG. 3 shows a more detailed view of the downhole clean out tool 150 within the BHA 100. In this figure, the member 110 is shown landed in the seat 164. As further shown in this drawing, the downhole clean out tool 150 includes a housing 152 (that can be, for example, exactly or about 30 feet long the same as a joint of tubing) that defines an inner volume 154 of the downhole clean out tool 150. In this example, the inner volume 154 is divided into a top portion 156 and a bottom portion 158 by the flow divider 162 (which includes or forms the seat 164). As shown, a flow conduit 170 (for example, a tubular flow conduit) is formed within the housing 152 and extends within both the top portion 156 and the bottom portion 158. The flow conduit 170 is positioned in the housing 152 to form a housing annulus 175 between the flow conduit 170 and an inner surface of the housing 152.

As shown in FIGS. 2 and 3, the top portion 156 includes a funnel 177 with an uphole (larger) end at or near the uphole connection 160 and a downhole (smaller) end that terminates at the seat 164 (for example, at the flow divider 162). The funnel 177 fluidly separates the top portion 156 into a section 181 in which the wellbore fluid 65 flows to the flow divider 162 and another section 183 in which no wellbore fluid 65 flows. As shown in FIG. 3 in particular, one or more flow ports 173 extend in the top portion 156 with corresponding inlets 182 at the funnel 177 and corresponding outlets 184 at the housing 152. Thus, the flow ports 173, which in this example, are angularly oriented such that the outlets 184 are pointed in a downhole direction. The flow ports 173, therefore, fluidly couple the section 181 of the top portion 156 (in other words, the section 181 within the funnel 177) to the annulus 60 through the housing 152 (while still nor having any wellbore fluid 65 flow from the top portion 156 to the bottom portion 158).

As shown in this example, one or more flow tubes 176 extend through the housing annulus 175 (external to the flow conduit 170). The one or more flow ports 174 are fluidly connected to the one or more flow tubes 176 so that wellbore fluid 65 flowing into the flow port(s) 173 flows into the flow tube(s) 176. One or more additional flow ports 174 are positioned to be fluidly connected to at least one flow tube 176 with outlets at the housing 152. As with the flow port(s) 173, the flow ports 174 are angularly oriented such that their outlets are also pointed in a downhole direction as shown.

Within the flow conduit 170 and downhole of the flow divider 1, the downhole clean out tool 150 in this example includes one or more screens 172, at least one screen 168, and a magnetized member 178 coupled to the flow conduit 170 with arms 180. In this example implementation, the screen 168 is positioned to extend across a flow area of the flow conduit 170 (for example, completely or substantially) in the bottom portion 158 of the internal volume 154 downhole of the magnetized member 178. As further shown in this example, the one or more screens 172 is positioned to extend across the flow area of the flow conduit 170 (for example, completely or substantially) in the bottom portion 158 of the internal volume 154 uphole of the magnetized member 178. The screens 168 and 172 can be comprised of a non-corrosive material with a mesh size selected to catch one or more debris 70 in the wellbore fluid 65 and, for example, impede or prevent such debris 70 from staying entrained in the wellbore fluid 65. In some aspects, a particular mesh size of each of the screens 168 and 172 can be different. For example, a mesh size of the screen 168 can be larger than the mesh size of the screens 172. In some aspects, a mesh size of successive screens 172 can decrease in an uphole direction (in other words, with the smallest mesh size of a particular screen 172 positioned closest to the flow divider 162).

In this example, the downhole connection 166 can comprise or be a flow inlet 186 to receive a flow of the wellbore fluid 65 circulated in an uphole direction (for example, from and through bottom sub-assembly 104) during operation of the downhole clean out tool 150. In some aspects, the screen 168 can act as a junk catcher to retain any debris 70 within the downhole clean out tool 150 (and specifically within bottom portion 158) during operation or movement of the downhole clean out tool 150. For example, debris 70 that are screened and removed from a flow of the wellbore fluid 65 can be retained by the screen 168. Further screens or baskets or fingers can also be positioned in the bottom portion 158 (or generally within the flow conduit 170) to catch and retain junk in the wellbore fluid 65 (screened by one or more of the screens 168 or 172 or otherwise).

As shown in this example, the magnetized member 178 can be a rod or other member formed of a magnetized material (metallic or otherwise). The magnetized member 178 can be, for instance, a permanent magnet that can magnetically attract metallic debris 72 out of a flow of the wellbore fluid 65.

As shown in this example, one or more flow ports 186 are positioned in the top portion 156 of the inner volume 154 to fluidly couple the bottom portion 158 to the top portion 156 through the flow divider 162. For example, as shown, the one or more flow ports 186 each include a flow inlet 188 positioned in the flow divider 162 (and in fluid communication with the flow conduit 170). The one or more flow ports 186 also each include a flow outlet 190 positioned at the housing 152 (and in fluid communication with the annulus 60). In this example, the flow ports 186 are angularly oriented such that the outlets 190 are pointed in an uphole direction into the annulus 60 when in the wellbore. In some aspects, check valves 191 can be positioned in the one or more flow ports 186 to prevent wellbore fluid 65 from flowing into the flow ports 186 from the annulus 60 (as well as in the one or more flow ports 173 and 174 to prevent wellbore fluid 65 from flowing into the flow ports 173 and 174 from the annulus 60).

In an example operation of downhole clean out tool 150, the downhole clean out tool 150 (for example, made up into the BHA 100) can be run into a wellbore on the downhole conveyance 55 to a particular location (for example, depth) within the wellbore. The particular location can be where a clean out operation is to begin in the wellbore with the downhole clean out tool 150. During the run in process and/or prior to imitation of the clean out operation, the wellbore fluid 65 (drilling fluid or other wellbore fluid) can be circulated downhole through the downhole conveyance 55, into the top sub-assembly 102 and to the downhole clean out tool 150 through the uphole connection 160. The flow of the wellbore fluid 65 circulates through the bore in the seat 164 and out of the downhole clean out tool 150 through the flow inlet 186. The wellbore fluid 65 can then circulate into the bottom sub-assembly 104 from the downhole clean out tool 150 and into the wellbore from the fluid inlet 106.

When a clean out operation is to be initiated with the downhole clean out tool 150, the member 110 can be "dropped" or circulated with the wellbore fluid 65 into the wellbore, where it eventually comes to a stop on the seat 164 and blocks the bore in the seat 164 from allowing fluid flow there through. As fluid pressure builds uphole of the seated member 110, a flow of the wellbore fluid 65 is circulated from the top portion 156 (for example, from the funnel 177) into the flow inlet(s) 182 of the flow port(s) 174. The flow of the wellbore fluid 65 is then circulated into the annulus 60 from the outlet(s) 184, while, in some aspects, simultaneously, flow of the wellbore fluid 65 is circulated into the flow tube(s) 176 and into the annulus 60 from the flow ports 174. Thus, during this part of the example operation, the wellbore fluid 65 is circulated into the annulus 60 from flow ports 173 and 174 while bypassing the flow conduit 170.

The flow of the wellbore fluid 65 into the annulus 60 from flow ports 173 and 174 eventually enters the flow inlet 186 (via the fluid inlet 106 of the bottom sub-assembly 104) and circulates in an uphole direction into the flow conduit 170. Thus, the flow of the wellbore fluid has been reversed from flowing through the flow conduit 170 (and out of the downhole clean out tool 150) in a downhole direction prior to seating of the member 110 to flowing through the flow conduit 170 in an uphole direction subsequent to seating of the member 110. As the wellbore fluid 65 flows uphole through the flow conduit 170, debris 70 can be screened or trapped in one or more of the screens 168 and/or 172. Metallic debris 72 in the flow of the wellbore fluid 65 can be magnetically attracted, and attached, to the magnetized member 178. A cleaned flow of the wellbore fluid 65 is further circulated from the screens 172 into the flow ports 186 (through flow inlets 188) and into the annulus 60 through the flow outlets 190. The flow of the wellbore fluid exits the flow outlets 190 in an uphole direction toward a terranean surface (where the fluid 65 can be further processed or cleaned, if necessary). Debris 70 and 72 can be retained in the downhole clean out tool 150 (for example, within the bottom portion 158 of the inner volume 154).

As the reverse circulation operational steps proceed, the downhole clean out tool 150 can be moved within the wellbore (in an uphole direction, in a downhole direction, or both in a series of movements) to further clean out portions of the wellbore. Once the clean out operation is completed, the downhole clean out tool 150 can be run out of the wellbore and to the surface, where the retained debris 70 and/or 72 can be removed or flushed from the downhole clean out tool 150. The downhole clean out tool 150 can then be run back into the wellbore (or into another wellbore) for another clean out operation.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole clean out tool, comprising:

a sub-assembly configured to couple to a downhole conveyance that extends in a wellbore from a terranean surface to a subterranean formation;

a housing coupled to the sub-assembly and defining an inner volume, the inner volume comprising a flow path that extends from an uphole end of the housing, through the housing, and to a downhole end of the housing that comprises a fluid inlet, the inner volume comprising a first inner volume portion and a second inner volume portion;

a plurality of first flow ports, each first flow port comprising an outlet oriented towards the downhole end of the housing and configured to fluidly couple the flow path to an annulus of the wellbore through the housing to direct a flow of a wellbore fluid circulated into the housing through the uphole end into the annulus in a downhole direction;

a seat formed in the housing and configured to receive a member inserted into the wellbore such that the flow of the wellbore fluid is diverted from the flow path, through the plurality of first flow ports, to the annulus, and to the fluid inlet based on the member seated on the seat;

a flow path tube that extends in the inner volume between the uphole end of the housing and the downhole end of the housing and forms at least a portion of the flow path;

a flow divider mounted in the flow path tube to fluidly separate the first inner volume portion from the second inner volume portion, the flow divider comprising or forming the seat;

at least one fluid tube that extends through an annular flow path between the housing and the flow path tube, each of the plurality of first flow ports fluidly coupled to the at least one fluid tube;

at least one screen positioned in the inner volume and configured to catch one or more debris in the flow of the wellbore fluid circulated into the flow path through the fluid inlet; and a second flow port comprising an outlet oriented towards the uphole end of the housing and configured to fluidly couple the flow path to the annulus of the wellbore through the housing to direct the flow of the wellbore fluid circulated into the flow path through the fluid inlet into the annulus in an uphole direction.

2. The downhole clean out tool of claim 1, wherein each first flow port is positioned to receive the flow of the wellbore fluid in the first inner volume portion, and the second flow port fluidly couples the second inner volume portion to the annulus through the flow divider.

3. The downhole clean out tool of claim 2, wherein the at least one screen is mounted in the second inner volume portion, and the tool further comprises a plurality of second flow ports that include the second flow port.

4. The downhole clean out tool of claim 3, further comprising:

at least one magnetic member mounted within the flow path and configured to magnetically attract at least a portion of the one or more debris; and a check valve mounted in the second flow port and configured to prevent wellbore fluid circulated into the flow path from the annulus.

5. The downhole clean out tool of claim 1, wherein the at least one screen is mounted in the second inner volume portion.

6. The downhole clean out tool of claim 1, further comprising:

a plurality of second flow ports that include the second flow port.

7. The downhole clean out tool of claim 1, further comprising at least one magnetic member mounted within the flow path and configured to magnetically attract at least a portion of the one or more debris.

8. The downhole clean out tool of claim 1, further comprising a check valve mounted in the second flow port and configured to prevent wellbore fluid circulated into the flow path from the annulus.

9. A method of cleaning out at least a portion of a wellbore, comprising:

running a downhole clean out tool into a wellbore on a downhole conveyance that extends in a wellbore from a terranean surface to a subterranean formation, the downhole clean out tool comprising:

a sub-assembly coupled to the downhole conveyance, a housing coupled to the sub-assembly and defining an inner volume, the inner volume comprising a flow path that extends from an uphole end of the housing, through the housing, and to a downhole end of the housing that comprises a fluid inlet, the inner volume comprising a first inner volume portion and a second inner volume portion, the flow path formed by a flow path tube that extends in the inner volume between the uphole end of the housing and the downhole end of the housing, a plurality of first flow ports that extends through the housing, each first flow port comprising an outlet oriented towards the downhole end of the housing, a seat formed in the housing, a flow divider mounted within the flow path tube and configured to fluidly separate the first inner volume portion from the second inner volume portion, the flow divider comprising or forming the seat, at least one fluid tube that extends through an annular flow path between the housing and the flow path tube, each of the plurality of first flow ports fluidly coupled to the at least one fluid tube, at least one screen positioned in the inner volume, and a second flow port that extends through the housing and comprises an outlet oriented towards the uphole end of the housing;

dropping a member into the wellbore to land on the seat;

subsequently to the member landing on the seat, diverting a wellbore fluid circulated to the downhole clean out tool through the downhole conveyance from the flow path, through the plurality of first flow ports, to an annulus of the wellbore, to the fluid inlet, and back into the flow path, the diverting comprising:

diverting the wellbore fluid from the flow path to the at least one fluid tube; and directing the wellbore fluid from the at least one fluid tube to the plurality of first flow ports and to the annulus of the wellbore;

catching, with the at least one screen, one or more debris in the flow of the wellbore fluid circulated into the flow path through the fluid inlet; and directing the flow of the wellbore fluid circulated into the flow path from the fluid inlet into the annulus through the second flow port in an uphole direction.

10. The method of claim 9, further comprising directing the wellbore fluid through a plurality of screens that includes the at least one screen, at least two of the plurality of screens having different mesh sizes.

11. The method of claim 10, further comprising:

magnetically attracting at least a portion of the one or more debris to at least one magnetic member mounted within the flow path; and preventing a flow of the wellbore fluid into the flow path from the annulus through the second flow port with a check valve mounted in the second flow port.

12. The method of claim 11, further comprising:

while diverting the wellbore fluid, moving the downhole clean out tool within the wellbore in an uphole direction on the downhole conveyance; and while diverting the wellbore fluid, moving the downhole clean out tool within the wellbore in a downhole direction on the downhole conveyance.

13. The method of claim 9, further comprising:

directing the wellbore fluid from the second inner volume portion through the flow divider with the second flow port.

14. The method of claim 9, further comprising magnetically attracting at least a portion of the one or more debris to at least one magnetic member mounted within the flow path.

15. The method of claim 9, further comprising preventing a flow of the wellbore fluid into the flow path from the annulus through the second flow port with a check valve mounted in the second flow port.

16. The method of claim 9, further comprising, while diverting the wellbore fluid, moving the downhole clean out tool within the wellbore in an uphole or downhole direction on the downhole conveyance.

17. The method of claim 9, further comprising moving the member onto the seat by circulating the wellbore fluid with the member through the downhole conveyance and into the housing.

18. A bottom hole assembly (BHA), comprising:

a top sub-assembly configured to couple to a downhole conveyance that extends in a wellbore from a terranean surface to a subterranean formation;

a bottom sub-assembly comprising a flow inlet configured to receive a flow of a wellbore fluid; and a downhole clean out tool fluidly coupled to the top and bottom sub-assemblies, the downhole clean out tool comprising:

a housing coupled to the top and bottom sub-assemblies and defining an inner volume, the inner volume comprising a flow path that extends from an uphole end of the housing in fluid communication with the top sub-assembly, through the housing, and to a downhole end of the housing that comprises a fluid inlet;

a flow tube external to and separated from the inner volume within a space between the flow path and the housing;

a first flow port comprising an outlet oriented towards the downhole end of the housing and configured to fluidly couple the flow path to an annulus of the wellbore through the flow tube and through the housing to direct a flow of a wellbore fluid circulated into the housing through the uphole end into the annulus in a downhole direction;

a flow divider that comprises a seat formed in the housing and configured to receive a member inserted into the wellbore such that the flow of the wellbore fluid is diverted from the flow path, through the flow tube and the first flow port, to the annulus, and to the fluid inlet based on the member seated on the seat;

at least one screen positioned in the inner volume and configured to catch one or more debris in the flow of the wellbore fluid circulated into the flow path, through the flow inlet of the bottom sub-assembly, and through the fluid inlet; and a second flow port comprising an outlet oriented towards the uphole end of the housing and configured to fluidly couple the flow path to the annulus of the wellbore through the housing to direct the flow of the wellbore fluid circulated into the flow path through the fluid inlet into the annulus in an uphole direction.

19. The BHA of claim 18, further comprising a cage positioned on the fluid inlet and configured to retain at least a portion of the one or more debris.

20. The BHA of claim 18, wherein the bottom sub-assembly comprises a mule shoe sub-assembly.

21. The BHA of claim 18 wherein the housing of the downhole clean out tool is threadingly coupled to each of the top and bottom sub-assembly.

22. The BHA of claim 18, wherein the downhole clean out tool is 30 feet in length.

23. The BHA of claim 18, wherein the downhole conveyance comprises a tubular work string.

* * * * *